US006675769B2

(12) United States Patent
Yip et al.

(10) Patent No.: US 6,675,769 B2
(45) Date of Patent: Jan. 13, 2004

(54) AIR MASS FLOW RATE DETERMINATION

(75) Inventors: James W Yip, Bakersfield, CA (US); Michael J Prucka, Grass Lake, MI (US); Daniel B Diebel, Ypsilanti, MI (US); Gregory L Ohl, Ann Arbor, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 128 days.

(21) Appl. No.: 10/003,990

(22) Filed: Oct. 31, 2001

(65) Prior Publication Data

US 2003/0083798 A1 May 1, 2003

(51) Int. Cl.[7] ..... F02D 41/14; G06G 7/70
(52) U.S. Cl. ..... 123/350; 60/602; 701/101
(58) Field of Search ..... 123/350, 399, 123/324, 330, 331, 436, 435; 60/600, 602, 605.2; 701/101, 102, 104, 108, 109

(56) References Cited

U.S. PATENT DOCUMENTS

| | | | | |
|---|---|---|---|---|
| 4,750,352 A | | 6/1988 | Kolhoff | |
| 5,261,236 A | | 11/1993 | Ironside et al. | |
| 6,020,652 A | | 2/2000 | Daudel et al. | |
| 6,055,811 A | | 5/2000 | Maddock et al. | |
| 6,134,888 A | | 10/2000 | Zimmer et al. | |
| 6,279,551 B1 | * | 8/2001 | Iwano et al. | 60/605.2 |
| 6,293,267 B1 | * | 9/2001 | Smith et al. | 701/108 |
| 2002/0189590 A1 | * | 12/2002 | Nakagawa et al. | 123/480 |

FOREIGN PATENT DOCUMENTS

| | | |
|---|---|---|
| EP | 0 476 811 A2 | 3/1992 |
| EP | 0 685 638 A2 | 12/1995 |
| EP | 1 203 869 A1 | 5/2002 |
| GB | 2 194 985 A | 3/1988 |

* cited by examiner

*Primary Examiner*—Tony M. Argenbright
*Assistant Examiner*—Arnold Castro
(74) *Attorney, Agent, or Firm*—Edwin W. Bacon, Jr.

(57) ABSTRACT

A method for characterizing an air mass flow rate target within an internal combustion engine. The method includes determining a reference air mass flow rate term, determining a predicted compressibility term, and processing these terms to determine an air mass flow rate target. The air mass flow rate term can be used as an input for vehicle controllers including those for controlling pressurized induction systems.

8 Claims, 2 Drawing Sheets

AIR MASS FLOW RATE DETERMINATION

FIELD OF THE INVENTION

The present invention relates generally to engine control systems for internal combustion engines, and more particularly to a method and apparatus for characterizing an air mass flow rate target.

BACKGROUND OF THE INVENTION

In general, internal combustion engines have at least one inlet manifold for supplying air or a combustible mixture of air and fuel to the engine combustion spaces. To increase the charge of combustible mixture that is supplied to the combustion spaces of the engine, it is common to employ pressurized induction systems, such as superchargers and turbochargers, which increase the amount of air delivered to the combustion spaces of the engine. Since fuel is metered to the engine as a function of the mass of air delivered to the combustion spaces, the amount of fuel delivered to the combustion spaces is also increased so as to maintain proper air/fuel ratio. As such, various performance aspects of the engine, such as power output and/or efficiency, can be improved over normally aspirated induction systems.

Turbochargers are a well known type of pressurized induction system. Turbochargers include a turbine, which is driven by exhaust gas from the engine, and a compressor, which is mechanically connected to and driven by the compressor. Rotation of the compressor typically compresses intake air which is thereafter delivered to the intake manifold. The pressure differential between the compressed air and the intake manifold air is known as turbo boost pressure.

At various times during the operation of the engine, it is highly desirable to increase, reduce or eliminate turbo boost pressure. This reduction is typically implemented by controlling the amount of exhaust gas provided to the turbocharger. One common method for controlling the amount of exhaust gas delivered to the turbocharger is a wastegate valve, which is employed to bypass a desired portion of the exhaust gas around the turbine. Most automotive turbochargers use a wastegate valve to control the amount of exhaust gas supplied to the turbine blades. By controlling the amount of exhaust gas that is bypassed around the turbine, the turbo boost pressure and the pressure in the intake manifold can be controlled. Therefore, it is important to determine how much exhaust gas must be bypassed for a given operating condition. If too much exhaust gas is bypassed, not enough power will be produced. Conversely, if not enough exhaust gas is bypassed, engine damage may occur due to an overboost condition.

Methods for controlling the wastegate are well known in the industry. Conventional systems attempt to control the boost pressure by "bleeding off" gas as boost pressure becomes too high. However, these conventional pressure-based systems are reactionary and have several drawbacks. In particular, control systems now often employ model based fueling methods which are based on air flow characteristics. Because most other fueling models target air flow to determine fuel delivery characteristics, it is also desirable to target air flow for engines having pressurized induction systems.

SUMMARY OF THE INVENTION

Accordingly, it is an object of the present invention to provide a method for controlling a wastegate which overcomes the shortcomings of the conventional pressure-based systems.

In one embodiment, the present invention provides a method for characterizing an air mass flow rate target within an internal combustion engine. The method includes determining a reference air mass flow rate term. In addition, a predicted compressibility term is determined. The reference air mass flow rate term and the predicted compressibility term are processed to determine an air mass flow rate target.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

Figure 1:
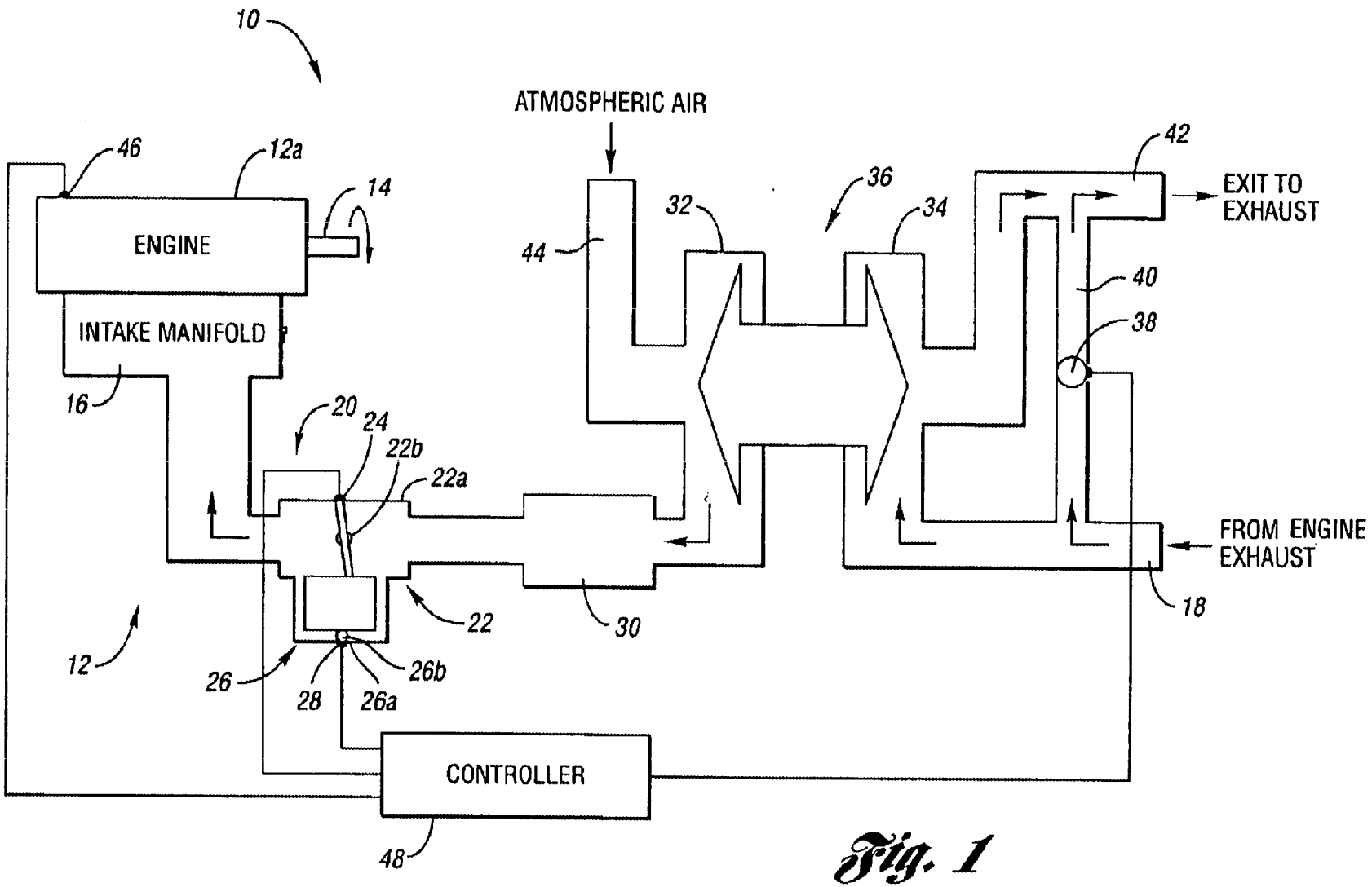
FIG. 1 is a schematic diagram of an exemplary motor vehicle including an engine with a turbocharger system and control unit according to the principles of the present invention.

With initial reference to FIG. 1, a motor vehicle constructed in accordance with the teachings of the present invention is generally identified by reference numeral 10. The motor vehicle 10 includes an engine assembly 12 having an engine 12*a* with an output shaft 14 for supplying power to driveline components and driven wheels (not shown). The engine assembly 12 includes an intake manifold 16 for channeling air to the engine combustion chambers (not shown) and an exhaust manifold 18 which directs the exhaust gases that are generated during the operation of the engine 12*a* away from the engine 12*a* in a desired manner. In addition, the engine assembly 12 includes fuel injection systems or carburetors (not shown).

An induction system 20 is located upstream of the intake manifold 16 and includes a throttle 22 having a throttle housing 22*a* and a throttle valve 22*b* which is pivotally mounted within the throttle housing 22*a* to thereby control the flow of air through the throttle housing 22*a*. A throttle position sensor 24 supplies a signal indicative of a position of the throttle valve 22*b*. Induction system 20 also includes an air bypass valve 26 located upstream of the intake manifold 16 and having an air bypass valve housing 26*a* and an air bypass valve element 26*b* which is mounted within the air bypass valve housing 26*a* to thereby control the flow of air through the air bypass valve housing 26*a*. Preferably, the air bypass valve element 26*b* is of the disc solenoid type. It will be appreciated that other air bypass valve elements may be used, such a solenoid plunger type. An air bypass position sensor 28 is used to sense controlling current of the air bypass valve element 26*b* to provide data which is indicative of a position of the air bypass valve element 26*b*.

The system 20 is equipped with an intercooler 30 provided in the form of, for example, a heat exchanger which reduces the temperature of compressed air in order to increase its density. The intercooler includes an inlet connected to a compressor 32 whose impellers are mechanically connected to the blades (not shown) of turbines 34. The compressor 32 and turbines 34 comprise turbocharger 36.

The blades (not shown) of the turbine 34 are driven by exhaust gas from the exhaust manifold 18. A wastegate 38 or exhaust bypass valve controls the flow of exhaust gas through bypass channels 40 which bypass the turbine 38, to control the speed of the turbine 34 and therefore the boosted pressure provided by the compressor 32. The exhaust gas from the turbine 34 and/or via the wastegate 38 and bypass channels 40 flow away through an exhaust channel 42. The compressor 34 may be connected to chamber 44 which contains an inlet for receiving air from the atmosphere.

A controller 48 is electronically coupled to the throttle position sensor 24, the air bypass position sensor 28, and an engine speed sensor 46, which generates a signal indicative of the rotational speed of the output shaft 14. One skilled in the art will appreciate that the sensor 46 may include a variety of devices capable of determining engine rotational speed. Specifically, an encoder (not shown) outputs electrical pulses every certain number of degrees of rotation of the output shaft 14. The encoder may be used in combination with a timer (not shown) to determine engine rotational speed. One skilled will further appreciate that other methods and mechanisms for determining the engine rotational speed may be implemented without departing from the scope of the present invention. The controller 48 is responsible for controlling the induction in response to the various sensor inputs and a control methodology.

Figure 2:
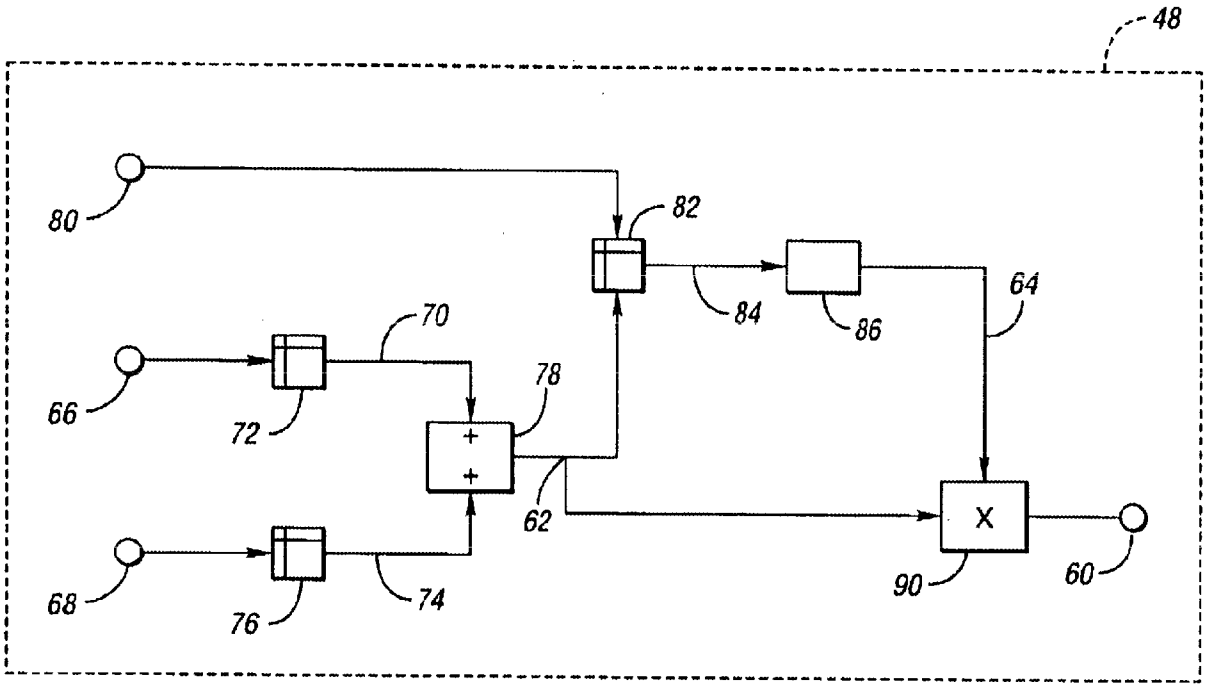
FIG. 2 is a flow diagram representative of the computer program instructions executed by the air mass flow rate determination system of the present invention.

As noted above, it is highly desirable that the magnitude of the turbo boost pressure be accurately calculated and controlled. One critical step, therefore, is to accurately calculate the mass flow rate of compressed air exiting the compressor of the turbocharger assembly, which hereinafter will be referred to as an air mass flow rate target. With reference to FIG. 2, the controller 48 of the present invention is schematically illustrated.

Referring to FIG. 2, the air mass flow rate target 60 can be determined based on obtaining two components, namely, a reference air mass flow rate term 62 and a compressibility term 64.

The reference air mass flow rate term 62 is obtained through a series of operations which include the determination of the throttle valve position 66 and the air bypass valve position 68.

Specifically, throttle position 66 is determined from a signal sent from throttle position sensor 24. A throttle sonic air flow term 70 is characterized by a look up table 72 based on throttle position 66 and sonic air flow. The look up table 72 is created by bench-mapping the throttle sonic airflow at a variety of engine throttle positions. Once the look up table 72 has been created, the table 72 is entered into the engine controller 48. If the exact value of the sonic air flow of the throttle position is not found in the look up table 72, a linear interpolation is performed to calculate the throttle position sonic air flow term 70.

The air bypass valve position 68 is determined from its controlling current sent from the air bypass valve position sensor 28. An air bypass valve sonic airflow term 74 is characterized by a look up table 76 based on the air bypass position and sonic air flow. The look up table 76 is created by bench-mapping the air bypass valve sonic airflow at a variety of air bypass valve positions. Once the look up table 76 has been created, the table 76 is entered into the engine controller 48. If the exact value of the sonic air flow of the air bypass valve position is not found in the look up table 76, a linear interpolation is performed to calculate the air bypass valve sonic air flow term 74.

As shown in processing module 78, the throttle sonic air flow term 70 and the air bypass valve sonic air flow term 74 are summed to obtain a total throttle and air bypass sonic air flow term. The total sonic air flow term is herein referred to as the reference air mass flow rate term 62.

The predicted compressibility term 64 is determined through a series of operations, including the sensing of engine rotational speed 80 via sensor 46 (see FIG. 1). Once the engine rotational speed 80 is determined, reference air mass flow rate term 62 and the engine rotational speed 80 are input into a surface look up table 82 to obtain a predicted pressure ratio 84. The predicted pressure ratio 84 is representative of the ratio of pressure at the intake manifold, or manifold absolute pressure (MAP), compared to the pressure before the throttle body, or throttle inlet pressure. The predicted pressure ratio 84 is determined by sampling the rotational speed sensor 46 and the reference air mass flow rate term 62 simultaneously and inputting the data into the surface look up table 82. If the exact values of the engine rotational speed 80 and the reference air mass flow rate term 62 are not found in the surface look up table 82, a linear interpolation may be performed to calculate the predicted pressure ratio 84.

The predicted pressure ratio 84 is used as an input to determine the compressibility term 64. Specifically, the predicted pressure ratio 84 is input into a processor 86. The processor 86 performs a mathematical manipulation to derive the predicted compressibility term 64 using the following equation:

$$\text{Phi} = \sqrt{\left(\frac{2}{k+1}\right)\left(r_p^{2/k} - r_p^{(k+1)/k}\right)}$$

where: Phi=compressibility term $r_p$=predicted pressure ratio k=fluid constant, which for air is 1.4.

As shown, the obtained predicted compressibility term 64 is input into a processor 90 along with the reference air mass flow rate term 62. The processor 90, in this case a multiplier, performs a mathematical manipulation to derive the air mass flow rate target 60 by the following equation:

$$\dot{m} = \dot{m}^* \text{Phi}$$

where: $\dot{m}$=air mass flow rate target $\dot{m}^*$=reference air mass flow rate term Phi=compressibility term.

The determined air mass flow rate target 60 is an input for other programs within the engine controller 48 and other vehicle component controllers, such as a module for controlling pressurized induction systems like a turbocharger or supercharger. The present invention provides a target air mass flow rate at standard temperature and pressure (STP) to be input into the intake manifold.

It should be noted that the methodology of the present invention has been shown and described in connection with an engine assembly connected to a pressurized induction system of the turbocharger type for exemplary purposes only. One of ordinary skill in the art will appreciate that other types of pressurized induction systems, such as the supercharger type, may alternatively be used without departing from the scope of the invention.

Figure 3:
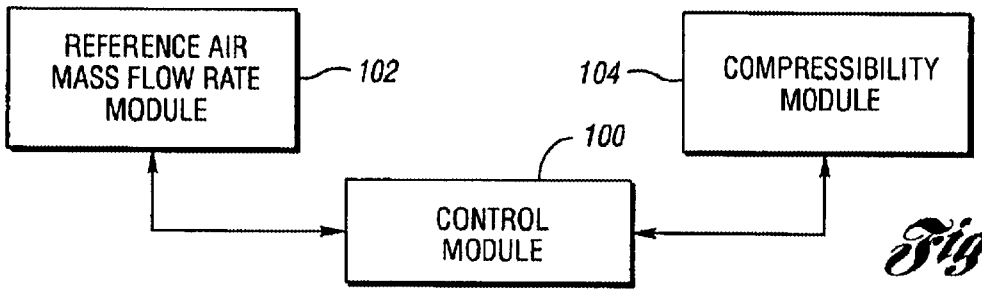
FIG. 3 is a logic diagram showing a representation of the turbocharger air mass flow rate determination system of the present invention.

In addition, one skilled in the art will appreciate that the before mentioned logical steps may be performed by individual modules in communication with each other as shown in FIG. 3. Control module 100 is in communication with a reference air mass flow rate module 102, where the reference air mass flow rate term 62 is calculated, and a compressibility module 104, where the compressibility term 64 is calculated.

It is intended that the invention not be limited to the particular embodiment illustrated by the drawings and described in this specification as the best mode presently contemplated for carrying out this invention, but that the invention will include any embodiment falling within the description of the appended claims.

What is claimed is:

1. A method for characterizing an air mass flow rate target in an internal combustion engine, comprising the steps of:

determining a reference air mass flow rate term;

determining an engine rotational speed term;

determining a compressibility term as a function of said engine rotational speed term; and processing said reference air mass flow rate term and said compressibility term to determine the air mass flow rate target.

2. The method of claim 1, wherein the step of determining the reference air mass flow rate term includes the step of summing a throttle sonic air flow term and an air bypass sonic air flow term.

3. The method of claim 2, wherein said throttle sonic air flow term is a function of throttle position and said air bypass sonic air flow term is a function of air bypass valve position.

4. The method of claim 1, wherein the step of processing said reference air mass flow rate term and said predicted compressibility term includes the step of multiplying said reference air mass flow rate term and said predicted compressibility term to determine the air mass flow rate target.

5. A method for characterizing an air mass flow rate target in an internal combustion engine, comprising the steps of:

determining a reference air mass flow rate term;

determining an engine rotational speed term;

comparing said engine rotational speed term and said reference air mass flow rate term to a previously defined surface look-up table to obtain a predicted pressure ratio;

determining a compressibility term as a function of said predicted pressure ratio; and processing said reference air mass flow rate term and said compressibility term to determine the air mass flow rate target.

6. A control system for controlling the air flow into an engine having an intake manifold, a throttle, an air bypass valve, a turbocharger and a wastegate, said control system comprising:

an engine speed sensor for sensing engine speed and generating an engine speed signal in response thereto;

a throttle position sensor for sensing throttle position and generating a throttle position signal in response thereto;

an air bypass valve sensor for sensing air bypass valve position and providing data indicative of said air bypass valve position; and a controller that receives and processes the engine speed signal, the throttle position signal, and the air bypass valve position data and determines a reference air mass flow rate term, an engine rotational speed term, and a compressibility term as a function of said engine rotational speed term;

wherein said controller determines an air mass flow rate target from a product of said reference air mass flow rate term and said compressibility term.

7. A method of characterizing an air mass flow rate target in an internal combustion engine, comprising:

determining an engine rotational speed term;

determining an air bypass valve position term; and determining a throttle position term;

wherein said engine rotational speed term, said air bypass valve position term and said throttle position term are employed to determine a reference air mass flow rate term and a predicted compressibility term which are multiplied to determine the air mass flow rate target.

8. A method for controlling the air flow into an engine having an intake manifold, a throttle, an air bypass valve, a turbocharger and a wastegate, said method comprising:

determining a throttle position;

determining a throttle position sonic air flow term based on said throttle position;

determining an air bypass valve position;

determining an air bypass valve sonic air flow term based on said air bypass valve position;

determining a reference air mass flow rate term based on said throttle position sonic air flow term and said air bypass valve sonic air flow term;

determining an engine rotational speed;

determining a predicted pressure ratio of an intake manifold pressure to a throttle inlet pressure based on said engine rotational speed and said reference air mass flow rate term;

determining a predicted compressibility term based on said predicted pressure ratio; and determining an air mass flow rate target based on said reference air mass flow rate term and said predicted compressibility term.

* * * * *